US005334972A

United States Patent [19]

Sugimoto et al.

[11] Patent Number: 5,334,972

[45] Date of Patent: Aug. 2, 1994

[54] INFRARED INTRUDER-DETECTION SYSTEM

[75] Inventors: Tadashi Sugimoto, Otsu; Yoshihiro Imuro, Gamo; Shigeki Nishimura, Kurita; Tatsuya Arimoto, Otsu, all of Japan

[73] Assignee: Optex Co., Ltd., Shiga, Japan

[21] Appl. No.: 34,588

[22] Filed: Mar. 22, 1993

Related U.S. Application Data

[63] Continuation of Ser. No. 703,146, May 17, 1991, abandoned.

[30] Foreign Application Priority Data

Jul. 11, 1990 [JP] Japan ..... 2-184545
Nov. 26, 1990 [JP] Japan ..... 2-323479

[51] Int. Cl.[5] ..... G08B 13/18

[52] U.S. Cl. ..... 340/556; 250/221; 359/159

[58] Field of Search ..... 340/556, 533, 539, 384 E, 340/691-693, 326, 328, 511, 384.1; 250/221; 455/613, 617; 359/152, 154, 155, 159

[56] References Cited

U.S. PATENT DOCUMENTS

| | | | |
|---|---|---|---|
| 3,329,946 | 7/1967 | Robbins | 340/533 X |
| 3,752,978 | 8/1973 | Kahl, Jr. et al. | 340/556 X |
| 4,186,388 | 1/1980 | Robinson | 340/539 X |
| 4,253,083 | 2/1981 | Imamura | 340/328 X |
| 4,650,990 | 3/1987 | Jonsson | 340/556 X |
| 4,949,075 | 8/1990 | Kurti et al. | 340/556 X |

*Primary Examiner*—Thomas Mullen
*Attorney, Agent, or Firm*—Koda and Androlia

[57] ABSTRACT

In a separate type infrared intruder-detection system consisting of an infrared beam projector and an infrared detector, the infrared detector is provided with a signal transmitter for transmitting an output level of the infrared detector, while the infrared beam projector is provided with a signal receiver for receiving a signal transmitted by the signal transmitter. These additionally equipped signal transmitter and signal receiver make it possible to achieve an initial beam-axis adjustment operation by one installation operator.

1 Claim, 2 Drawing Sheets

INFRARED INTRUDER-DETECTION SYSTEM

This is a continuation of application Ser. No. 703,146, filed May 17, 1991, now abandoned.

The present invention relates to an infrared intruder-detection system, and more particularly to an intruder detection system devised so as to generate a detection signal when a prepared infrared beam is intercepted by an intruder.

An infrared intruder-detection system of this type consists essentially of an infrared beam projecting part and an infrared beam detecting part combined with an intruder detection signal generator devised so as to generate a signal when the level of detected infrared rays decreases to zero in substance.

In installing such a system, which can be applied to a linear area ranging from the order of a meter to several hundred meters, it is essentially important to make the infrared beam projecting part have its beam projecting axis made to coincide precisely with the beam receiving axis of the infrared detecting part. Therefore, installation of the system, particularly covering a long distance over one hundred meters, is accompanied by a very troublesome beam axis adjusting work, which is to be achieved by two installation operators with a special communication means provided between them; one of the two installation operators is on the side of the infrared beam projecting part as projector-side operator and the other stays on the side of the infrared beam detecting part as detector-side operator. With the two operators thus disposed, the projector-side operator, for instance, initially adjusts the beam projection direction of the infrared beam projecting part, according to the instructions given by the detector-side operator through the above-mentioned communication means, so that the beam detecting part, which is kept watched by the detector-side operator, has its output level indicator made to show a maximum value. With the beam projection direction thus properly adjusted, the detector-side operator then adjusts the beam receiving direction of the beam detecting part by making the output level indicator again show a maximum value. The above briefed troublesome beam axis adjustment work is an essential disadvantage of a conventional separate type infrared intruder-detecting system consisting of an infrared beam projecting part and an infrared beam detecting part.

OBJECTS AND SUMMARY OF THE INVENTION

The present invention aims at resolving the above briefed disadvantage involved in the work of installing a separate type infrared intruder-detection system consisting of an infrared beam projecting part and an infrared detecting part, and makes it an object to provide an improved infrared intruder-detection system additionally provided with a signal feedback system through which only one installation operator can easily achieve the beam axis adjustment.

Another object of the present invention is to constitute the above signal feedback system as a separate system capable of being connected to a main infrared intruder-detection system only when a beam axis adjustment is to be made on the main intruder detection system.

To achieve the above objects the above-mentioned signal feedback system consists essentially of a signal transmitter and a signal receiver; the signal transmitter, which belongs to the infrared beam detecting part, transmits a signal reflecting an output level of the beam detecting part to the infrared beam projecting part, while the signal receiver, which belongs to the beam projecting part, receives and indicates, on a receiver-side level indicator, the signal transmitted from the transmitter. Further, the signal transmitter is accompanied by a transmitter-side level indicator for indicating an output level of the beam detecting part. Besides, in one of the embodiments of the invention, the signal feedback system is eliminated and, instead, the infrared beam system for detecting an intruder is modified so as to be used also for beam axis adjustment.

With the signal feedback system thus constituted, only one installation operator, first staying at the infrared beam projecting part, adjusts the beam projection direction by making the above receiver-side level indicator show a maximum value, and then moves to the infrared beam detecting part to adjust the beam receiving axis of the beam detecting part, watching the above transmitter-side level indicator. In this manner, the present invention makes it possible for one installation operator to properly adjust the beam axis of a separate type infrared intruder-detection system consisting of an infrared beam projecting part and an infrared beam detecting part.

BRIEF DESCRIPTION OF THE DRAWINGS

The present invention is described in further detail in the following on reference to the accompanying drawings, in which.

DETAILED DESCRIPTION OF THE INVENTION

Figure 1:
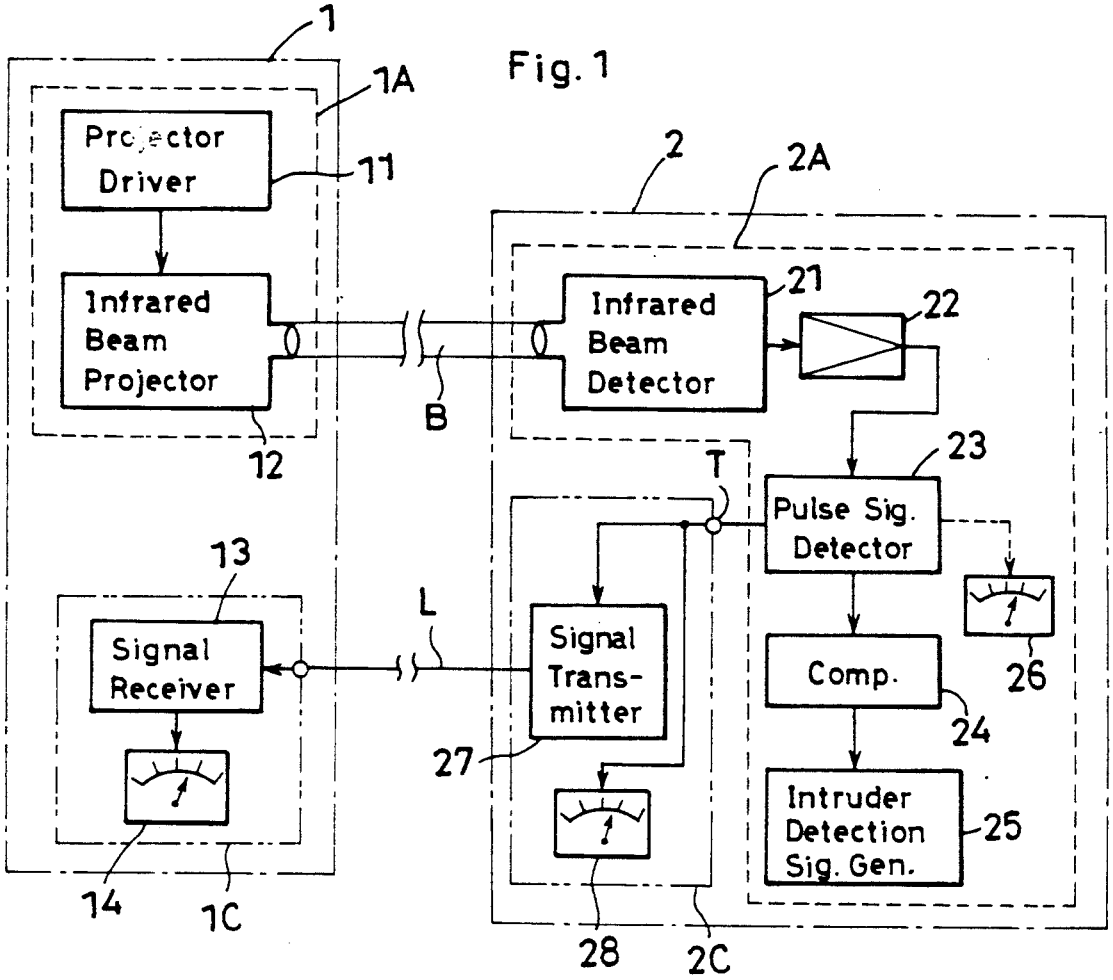
FIG. 1 shows a block diagram constitution of a first embodiment of the present invention.

As is easily imagined from FIG. 1 illustrating the constitution of a first embodiment of the present invention, the infrared intruder-detection system according to the present invention is basically constituted by combining a conventional typical separate type infrared intruder-detection system made up of an infrared beam projecting part 1A and a beam detecting part 2A with a newly devised signal feedback system consisting of a signal transmitting section 2C and a signal receiving section 1C, the signal feedback system being characteristic of the present invention. In advance of proceeding to the characteristic part of the invention, the operation of the conventional part is reviewed briefly. Referring to dotted-line enclosures 1A and 2A in FIG. 1, an infrared beam projector 12, driven by a projector driver 11, projects a pulsed infrared beam B toward an infrared detector 21, which converts the pulsed infrared beam B into a series of electric pulse signals. The pulse signals are amplified by an amplifier 22 and then inputted to a pulse signal detector 23, which outputs a DC signal reflecting only the intensity of the pulsed infrared beam B, excluding background components of infrared rays undesirably irradiating the infrared detector 21. The pulse signal detector 23 has its output indicated on a level indicator 26 and, at the same time, led and inputted to a comparator 24, which, comparing the input with a predetermined low voltage, outputs a high or low level signal if the input decreases substantially to zero with the infrared beam B intercepted by an intruder. The high or low level signal outputted from the comparator 24 makes an intruder detection signal generator 25 output an alarm signal or the like.

In the first embodiment shown in FIG. 1, a signal feedback system, which consists of a signal transmitting section 2C and a signal receiving section 1C, is combined with the above briefed conventional composition to constitute the present invention, whose infrared beam projecting part 1 is made up of the signal receiving section 1C and the conventional beam projecting part 1A and whose infrared beam detecting part 2 is made up of a signal transmitting section 2C and the conventional beam detecting part 2A. Further, the signal transmitting section 2C consists of a signal transmitter 27 and a level indicator 28, while the signal receiving section 1C consists of a signal receiver 13 and a level indicator 14. Both the signal transmitter 27 and the signal receiver 13 are made of amplifiers or the like.

With the embodiment thus constituted, the pulse signal detector 23 has its output indicated on the level indicator 28 (therefore, the level indicator 26 can be eliminated) and, at the same time, transferred to the signal receiver 13 by the signal transmitter 27 through an electric cable L. Receiving a signal transfered from the signal transmitter 27, the signal receiver 13 eventually outputs a signal reflecting the output of the pulse signal detector 23. According to the present invention, only one installation operator can achieve a proper infrared beam axis adjustment: the operator, first staying at beam projecting part 1, finely adjusts the direction of the infrared beam projector 12 so that the level indicator 14 indicates a maximum value, and then moves to the beam detecting part 2 to finely adjust the direction of the infrared beam detector 21 so that the level indicator 28 indicates a maximum value.

Figure 2:
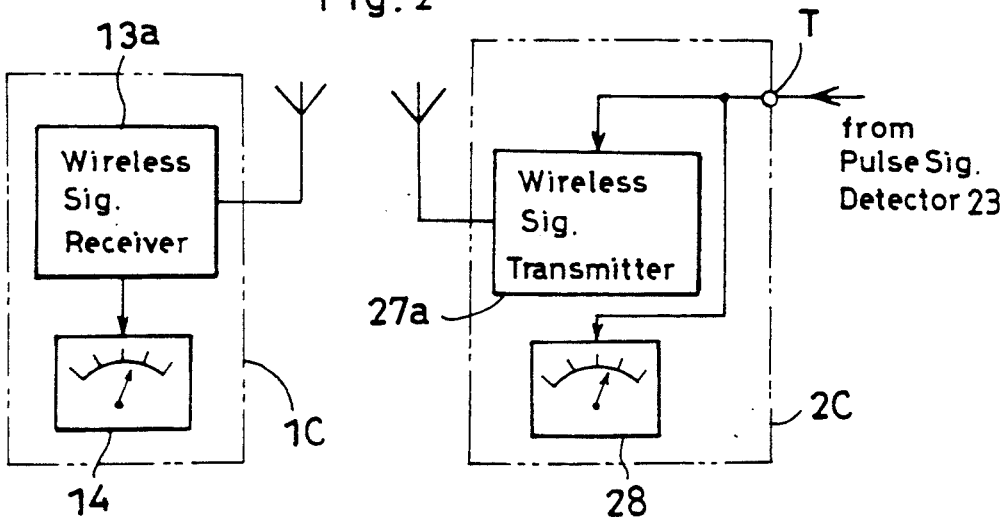
FIG. 2 shows a partial block diagram constitution of a second embodiment of the present invention.

FIG. 2 shows a partial block diagram illustrating the signal feedback system in a second embodiment of the present invention. According to the second embodiment the signal transmitter 27 and signal receiver 13 in the first embodiment are formed as a wireless transmitter **27*a* and a wireless receiver 13*a*, respectively. In this embodiment, therefore, the signal transmission from the signal transmitting section 2C to the signal receiving section 1C is by means of an electromagnetic wave. This embodiment can be further modified by employing as the wireless receiver 13*a*** a commercially available radio receiver.

Figure 3:
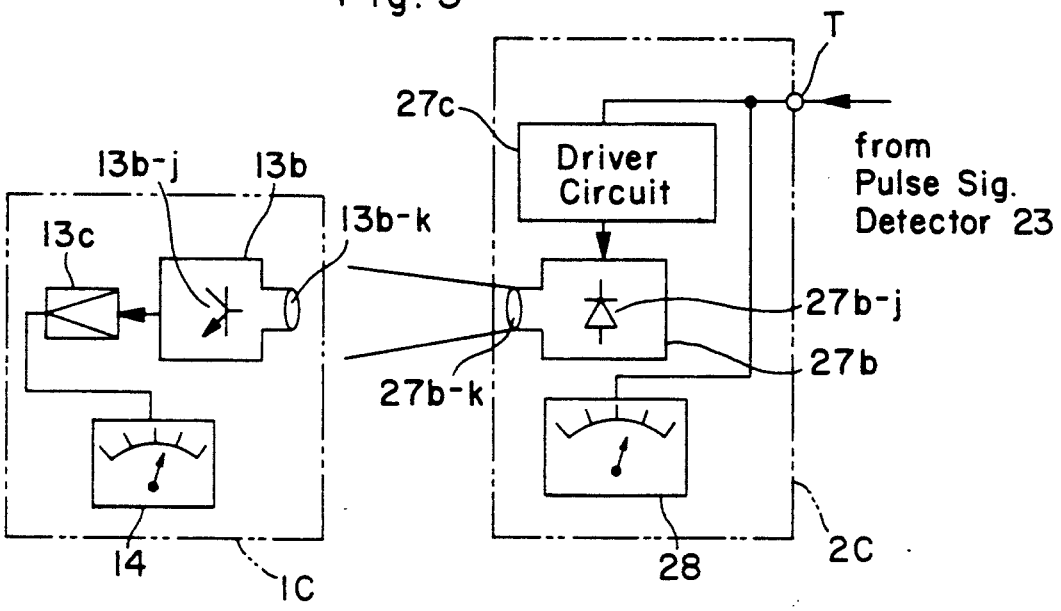
FIG. 3 shows a partial block diagram constitution of a third embodiment of the present invention.

According to a third embodiment of the present invention, the signal transmission from the signal transmitting section 2C to the signal receiving part 1C is by means of an optical beam, as is shown in FIG. 3 illustrating a partial constitution of the third embodiment. In this embodiment the signal transmitter 27 in the first embodiment is replaced by a light beam projector **27*b* driven by a driver circuit 27*c*, while the signal receiver 13 in the first embodiment is replaced by a photodetector 13*b* and an amplifier 13*c* for amplifying the output signal from the photodetector 13*b*. The light beam projector 27*b* consists, for example, essentially of a light emitting diode 27*b–j* and a projector lens 27*b–k*. The light emitting diode 27*b–j*, having its lighting intensity controlled by the output signal of the pulse signal detector 26 (FIG. 1) through the driver circuit 27*c*, optically transmits the output level of the pulse signal detector 26 to the photodetector 13*b* of the signal receiving section 1C. The photodetector 13*b* is made up of a photo-transistor 13*b–j* and a condenser lens 13*b–k*. An output from the photodetector 13*b* is amplified by the amplifier 13*c* and then indicated on the level indicator 14. In this embodiment, the optical beam made by the projector lens 27*b–k* is preferably somewhat diverging, because it is nonsense if a precise beam axis adjustment work is needed also for this optical beam which is used only for adjusting the axis of the infrared beam B (FIG. 1**) of the main part of the intruder detection system.

In all of the above first, second and third embodiments, the signal feedback system consisting of a signal transmitting section 2C and a signal receiving section 1C can be constituted as a separate system detachable from the main part of the intruder detection system through a terminal T (refer to FIGS. 1, 2 and 3).

Figure 4:
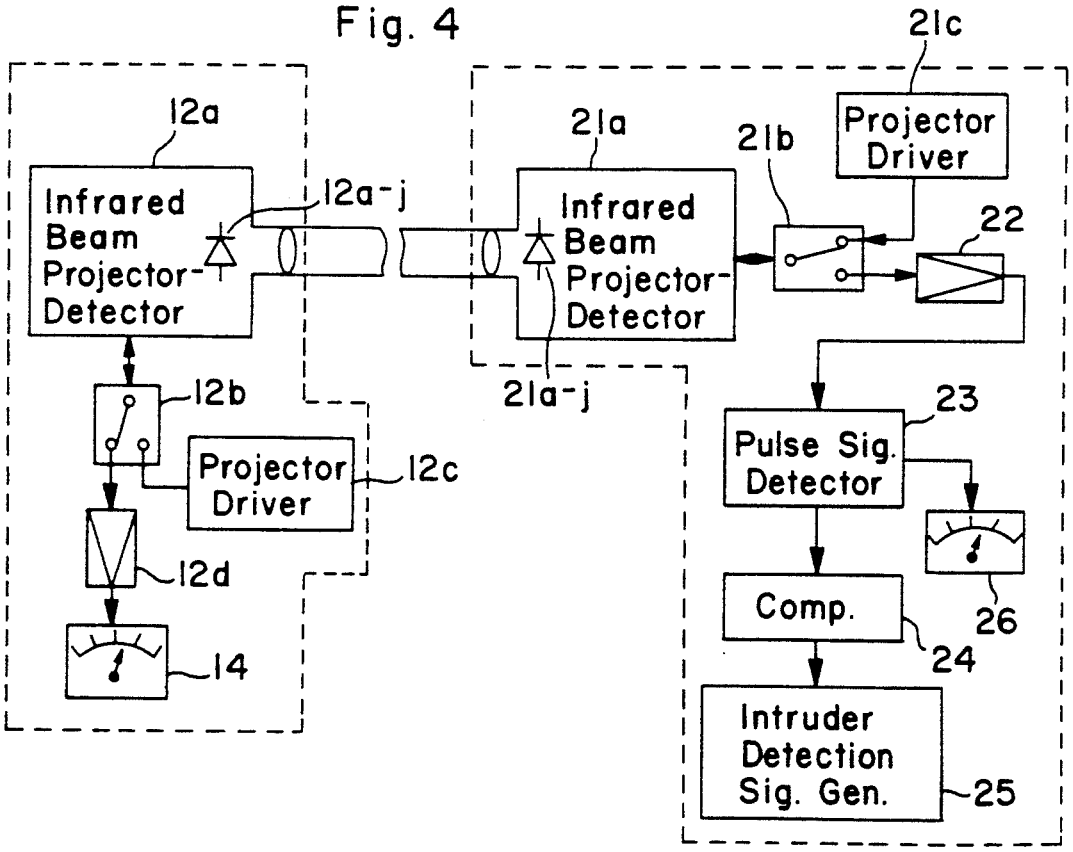
FIG. 4 shows a block diagram constitution of a fourth embodiment of the present invention.

The present invention can be embodied, as a fourth embodiment, with the intruder detection infrared optical system made to double as a beam axis adjusting means. According to this embodiment, the special signal feedback system used in the preceding embodiments is eliminated and, instead, both constituents corresponding to the infrared beam projector 12 and infrared beam detector 21 in FIG. 1 are respectively constituted, as is shown in FIG. 4, with infrared beam projector-detectors **12*a* and 21*a*. In FIG. 4 the same constituents as those shown in FIG. 1 are indicated with the same reference signs as used in FIG. 1. The infrared beam projector-detectors 12*a* and 21*a*, in which are used infrared photodiodes 12*a–j* and 21*a–j* respectively, can be switched, respectively, between a projector driver 12*c* and an amplifiers 12*d*, and between a projector driver 21*c* and an amplifier 22. With the beam projector-detector 12*a* switched to the amplifier 12*d* and the beam projector-detector 21*a* switched to the projector driver 21*c*, the beam projector-detector 12*a* can be properly directed to the beam projector-detector 21*a* through monitoring a level indicator 14. With the beam projector-detector 12*a* switched to the projector driver 12*c* and the beam projector-detector 21*a* switched to the amplifier 22, then the beam projector-detector 21*a* can be properly directed to the beam projector-detector 12*a* through monitoring a level indicator 26. Further, with this latter switch setting, the entire system of this embodiment, of course, functions as an infrared intruder-detection system. This fourth embodiment makes use of the property that a photodiode can act in two ways as a light emitter and as a light detector. It is necessary that both the infrared photodiodes 12*a–j* and 21*a–j*** have their respective spectral peaks substantially at the same wavelength.

All of the above embodiments shown in FIGS. 1 to 4 can be made put into practice with any one of the level indicators 14 (FIGS. 1 to 4), 28 (FIGS. 1 to 3) and 26 (FIG. 4) constituted as a sound generator devised so as to generate sound whose magnitude or frequency reflects the level of a signal inputted thereto.

We claim:

1. An infrared intruder-detection system comprising:

a first and a second optical means each of which comprises a single infrared photo diode which selectively functions either as an infrared beam projector or as an infrared beam detector and said first and second optical means selectively function such that either said infrared photo diode of said first optical means projects and said infrared photo diode of said second optical means detects an infrared beam or said infrared photo diode of said second optical means projects and said infrared photo diode of said first optical means detects an infrared beam;

a first level indicator for providing an indication having a magnitude which reflects a magnitude of an output signal of said first optical means only while the infrared photo diode of the same is functioning as an infrared beam detector; and a second level indicator for providing an indication having a magnitude which reflects a magnitude of an output signal of said second optical means only while the infrared photo diode of the same is functioning as an infrared beam detector;

whereby said first and second optical means are individually and precisely aligned by directing said first optical means toward said second optical means while said first optical means functions to detect an infrared beam until the magnitude of the indication on said first level indicator is at a maximum, and directing said second optical means towards the first optical means while said second optical means functions to detect an infrared beam until the magnitude of the indication on said second level indicator is at a maximum.

* * * * *